US007749287B2

(12) United States Patent
de Lorenzo

(10) Patent No.: US 7,749,287 B2
(45) Date of Patent: Jul. 6, 2010

(54) PROCESS TO APPLY DIGITAL IMAGES IN STRAPS

(75) Inventor: Ricardo Augusto de Lorenzo, Sao Paulo (BR)

(73) Assignee: Beltgroup Do Brasil LTDA, Sao Paulo (BR)

( * ) Notice: Subject to any disclaimer, the term of this patent is extended or adjusted under 35 U.S.C. 154(b) by 884 days.

(21) Appl. No.: 10/582,290

(22) PCT Filed: Dec. 16, 2004

(86) PCT No.: PCT/BR2004/000246

§ 371 (c)(1),
(2), (4) Date: Jun. 12, 2006

(87) PCT Pub. No.: WO2005/084949

PCT Pub. Date: Sep. 15, 2005

(65) Prior Publication Data

US 2007/0124873 A1 Jun. 7, 2007

(30) Foreign Application Priority Data

Mar. 2, 2004 (BR) ..... 0400373

(51) Int. Cl.
*D06P 5/24* (2006.01)
*D06P 5/26* (2006.01)

(52) U.S. Cl. ..... 8/470; 8/107; 8/471; 8/467; 101/251

(58) Field of Classification Search ..... 8/470–586, 8/107, 467; 101/251
See application file for complete search history.

(56) References Cited

U.S. PATENT DOCUMENTS

| | | | | |
|---|---|---|---|---|
| 4,326,003 | A * | 4/1982 | Bouhaniche | 428/198 |
| 4,541,340 | A * | 9/1985 | Peart et al. | 101/470 |
| 4,767,420 | A * | 8/1988 | Mehl et al. | 8/470 |
| 6,244,176 | B1 * | 6/2001 | Sonobe et al. | 101/217 |
| 2004/0146698 | A1 * | 7/2004 | Pace et al. | 428/195.1 |

* cited by examiner

*Primary Examiner*—Lorna M Douyon
*Assistant Examiner*—Tri V Nguyen
(74) *Attorney, Agent, or Firm*—McCormick, Paulding & Huber LLP

(57) ABSTRACT

The present invention refers to a process and to an equipment and machine, which allow the application of digital images to straps, webbings and belts of different kinds and sizes destined to different applications and is achieved in a way to provide the continuous transferring of digital images or a trace to straps, where the straps are manufactured with an ordinary weave or with an special weave to receive a bleaching treatment with an optical white, as well as pass by a thermo-fixation process that creates an alteration at the material properties, enabling, this way, various printings in high quality.

2 Claims, 6 Drawing Sheets

PROCESS TO APPLY DIGITAL IMAGES IN STRAPS

CROSS REFERENCE TO RELATED APPLICATIONS

This application is entitled to the benefit of and incorporates by reference essential subject matter disclosed in International Patent Application No. PCT/BR2004/000246 filed on Dec. 16, 2004 and Brazil Patent Application No. PI0400373-3 filed Mar. 2, 2004.

FIELD OF THE INVENTION

Particularly, the present invention is related to a process, machine and equipment, which allow the transferring of digital quality images to the obtained straps of multiple types for different applications.

The present invention refers to a process that allows the transferring of digital images to straps made of synthetic material.

Said straps, made of synthetic material may be of any size and type and may be destined to multiple applications.

The most ordinary applications are cars seat belts, working safety belts, airplanes seat belts, line organizer poles with belts, among others.

The present invention also refers to the equipment developed to be used in the inventive process of obtaining the webbing, belt and the like, as well as the machine and the devices used to transfer said digital images to said inventive webbing, belt and the like obtained.

BACKGROUND OF THE INVENTION

As well known by those skilled in the present art, the straps in general, used in the above cited applications cannot receive a digital image printing.

This way, every time it has been necessary to transfer any image and/or information to said straps, such transferring process was carried out through silkscreen printing or the image and/or information was embroidered directly to the straps.

Such image and/or information processes transferring present some limitations, once they do not allow images with photographic or digital quality to be transferred to the straps.

Therefore, the processes of the state of the art do not permit the images reproduction in a satisfactory way and accomplish results a lot under than what is desired in terms of quality and graphic resolution.

This way, with the development of new image and/or information transferring processes, it was evolved a new process that allows the transferring of digital, photographic and chrome-like images to different kinds of materials and/or medias, being such process defined as sublimation.

As per said sublimation process, digital quality image printings can be reproduced on several kinds of materials and/or medias.

The image to be transferred is printed with a transferable ink on an special transferring paper which, after being printed is placed upon the piece/media destined to receive the image. Said piece/media surface is placed in direct contact with the printed special transferring paper surface.

The array is duly heated to a predetermined temperature, with a predetermined pressure being applied thereto. Through the heat and the pressure applied against the said image receiving piece/media, and the printed special transferring paper, the printed image is ineffaceably and permanently transferred to the piece/media with a high optical quality.

However, the referred sublimation process presents some drawbacks, among those, the following are highlighted:

a) Non continuous process; and b) Possibility to sublimation transferring only to one side/face of the piece/media.

The non continuous sublimation transferring process is due to the high quality of the images to be transferred what forces the transferring to be made piece by piece, using one printed paper per each transferring, as per example sports teams uniforms (soccer t-shirts).

Due to the heating, what is part of the sublimation transferring process and the ineffaceably and permanently characteristics given by said process to the transferred image, once it is placed to one side/face of the receiving piece/media.

Due to the fact that it is accomplished piece by piece using one printed paper per each transferring.

Due to the fact that the heating and the pressure application are part of the sublimation process, in the moment the user desires to print the other side/face of the receiving piece/media, the side already printed loses quality and/or gets damaged by the heat/pressure.

This last inconvenient limits the sublimation process, mainly when high quality images are to be transferred to webbings, belts or the like.

BRIEF SUMMARY OF THE INVENTION

According to what was stated above, and aiming to give a solution to the drawbacks presented in the images transferring processes of the state of the art, the invention contained herein was developed to grant a innovative solution to the application of the sublimation process mainly to straps, as well as said straps therefrom obtained in different sizes for assorted utilizations.

Within the scope of the present invention, it is the main object of the present invention the presentation of a new process employing an specific machine and equipment that enables the continuous and serial image transferring through sublimation printing to straps.

Yet, within the scope of the present invention, it is another object of the present invention, that the straps obtained, may be presented in assorted widths and thickness, being produced in synthetic material (polyester, nylon, etc.), which are used in the conformation of straps to be employed as cars seat belts, working safety belts, airplanes seat belts, line organizer poles with belts, among others.

Yet, within the scope of the present invention, it is another object of the present invention that the process, the machine and the equipment developed for obtaining the straps as herein described, allow the continuous and serial image transferring through sublimation printing to both sides/faces of said straps in one single operation, what facilitates and minimizes the production time.

Another feature, yet within the scope of the present invention, that constitutes a further object of the present invention is presenting a webbing, belt and the like, able to bear the transferring of digital, photographic, chrome-like, traces and multiple other kinds of high quality images, obtained from digital equipment to one or both sides/faces of said straps, according to the utilization requirements.

Therefore, the features cited above, grant to the straps a wider range of utilization and employment, being possible that such straps undertake an advertising and communication aspect, or undertake new decorative aspects, or, even undertake aspects of safety items printing, what were previously applied to the straps by sewing.

BRIEF DESCRIPTION OF THE DRAWINGS

For a better understanding of the characteristics and features of the present invention, it can be found bellow the detailed description of this invention, referring to the following depicted drawings, where:

FIG. 2 shows a side view drawing of the cutting equipment used in obtaining the said webbing, belt and the like;

DETAILED DESCRIPTION OF THE INVENTION

Figure 1:
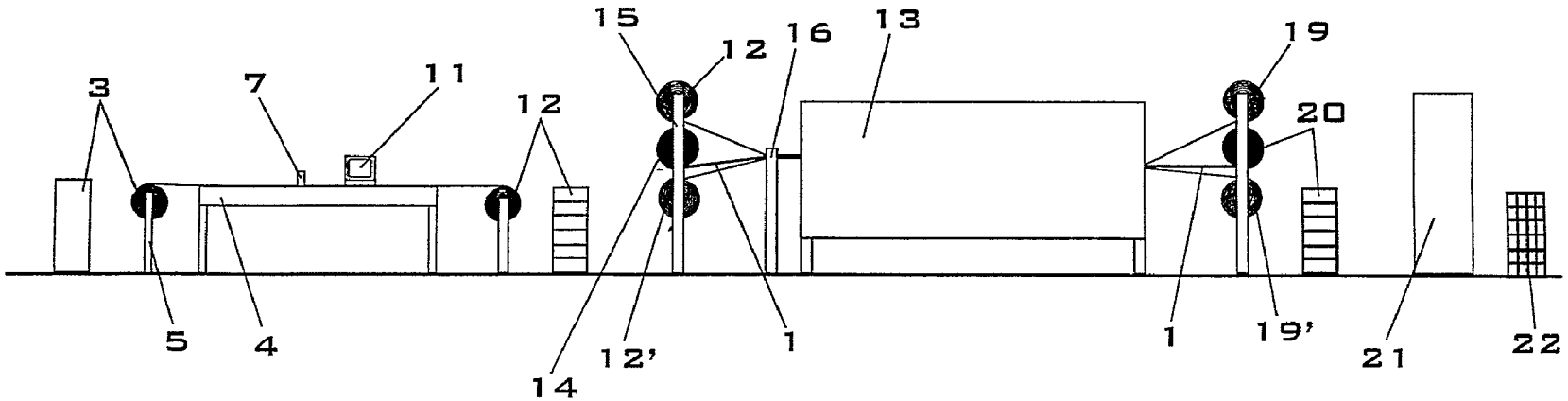
FIG. 1 shows a schematic drawing of the production process flow of the referred webbing, belt and the like bearing a digital image printing.
Figure 2:
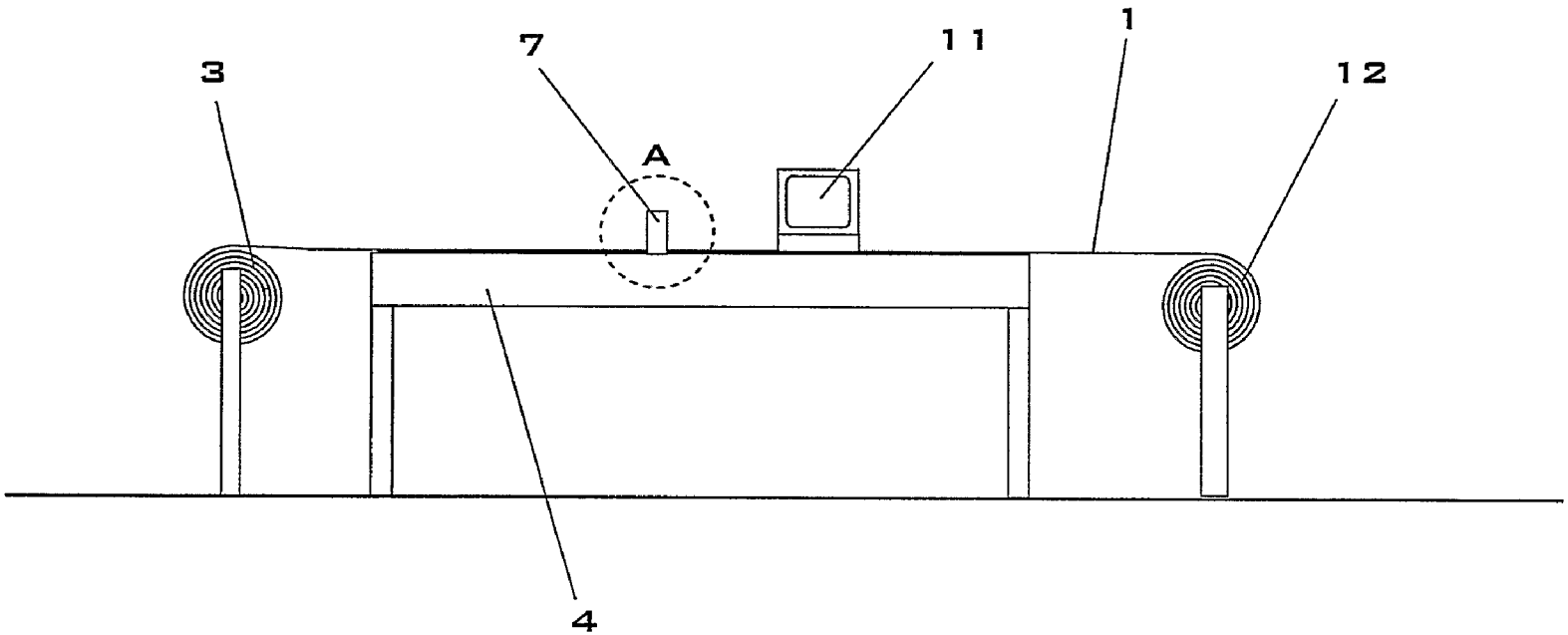
Figure 3:
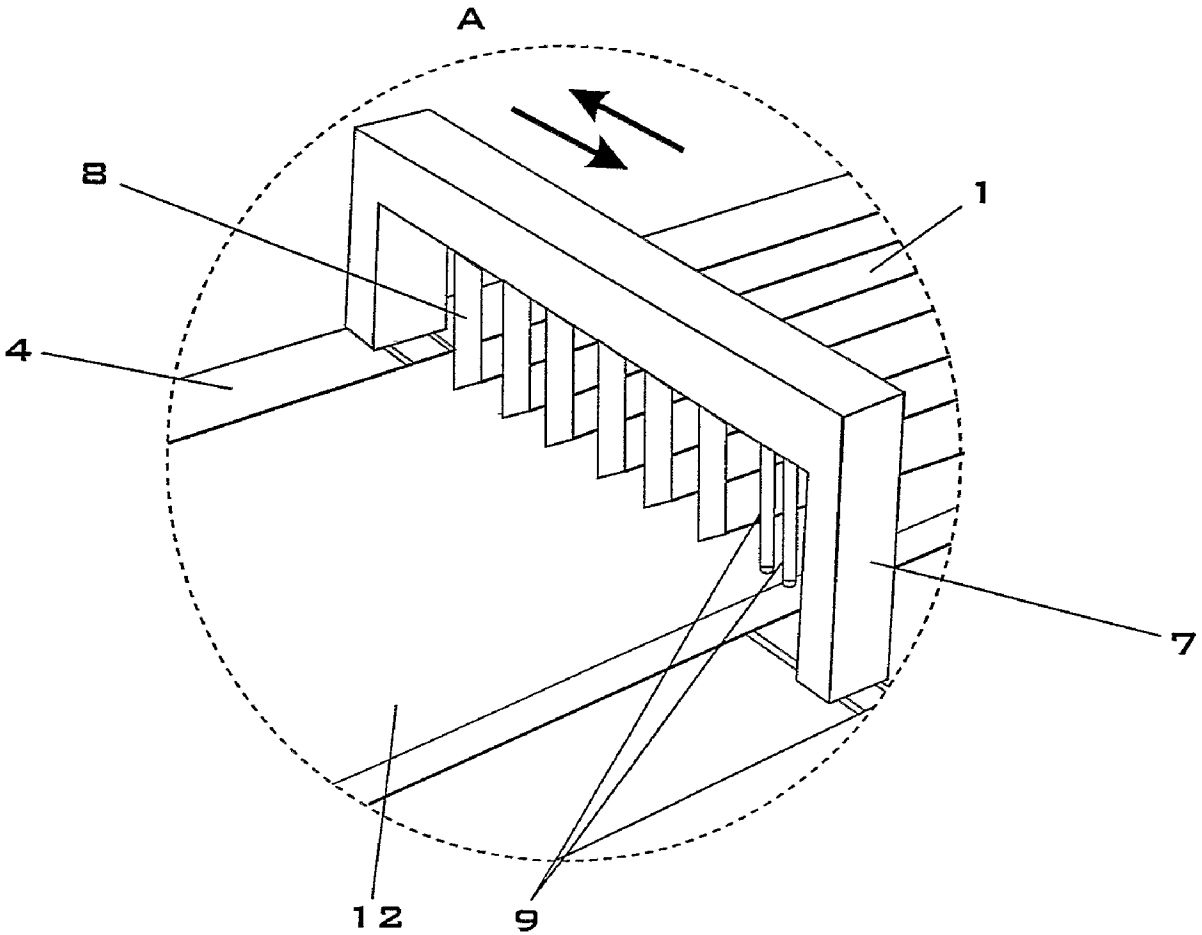
FIG. 3 shows a schematic perspective drawing of the detail 3, shown in FIG. 2, depicting the alignment device of the cutting knives used for cutting the webbing, belt and the like reels.
Figure 4:
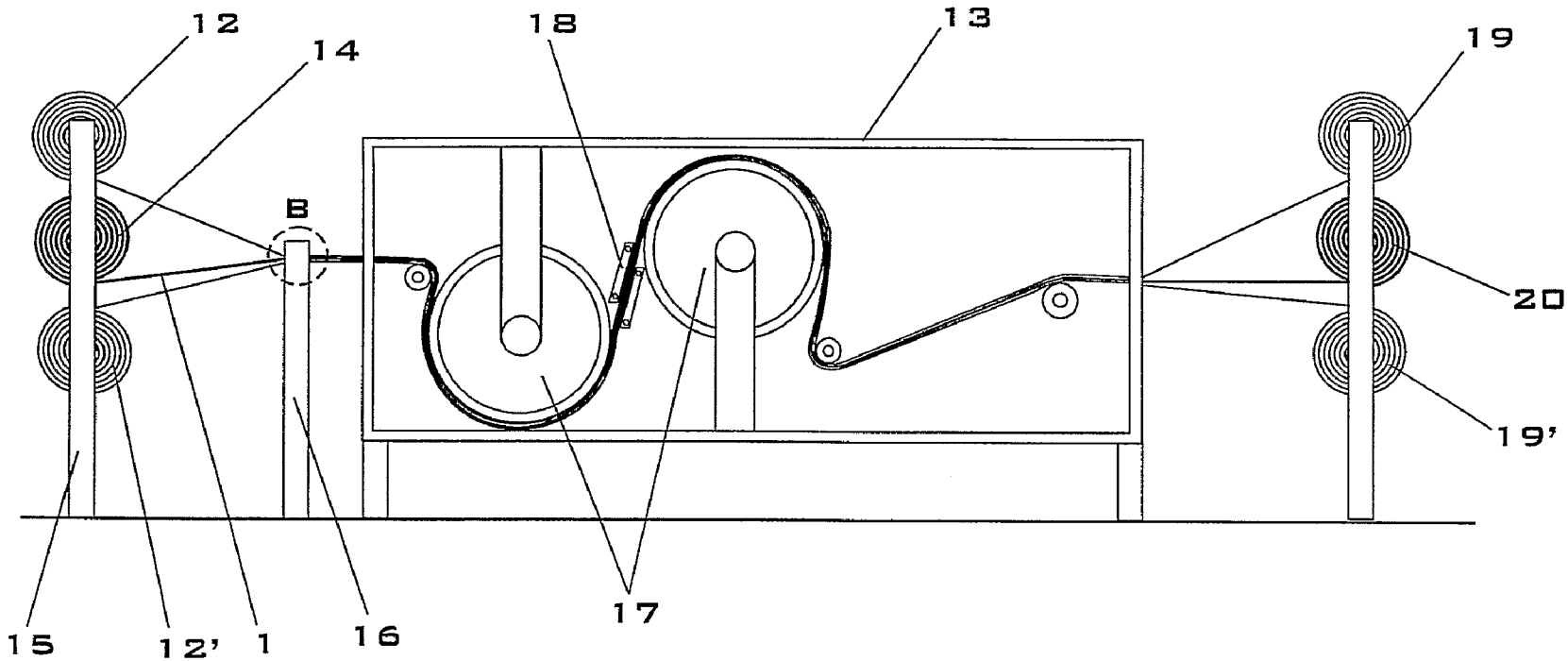
FIG. 4 shows a schematic drawing of a side view section of the straps printing machine.
Figure 5:
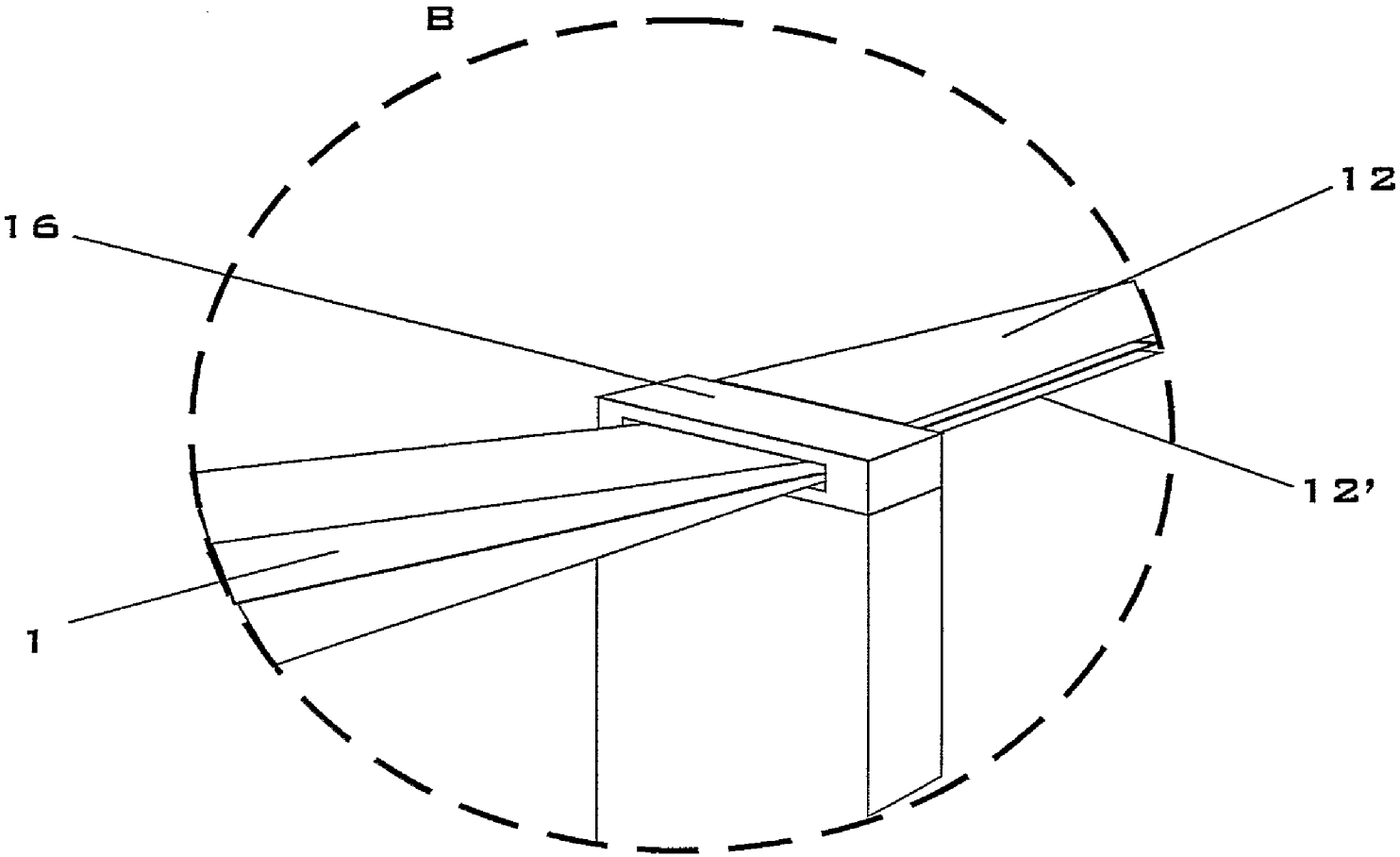
FIG. 5 shows a schematic perspective drawing illustrating the detail 5, shown in FIG. 4, depicting the alignment device of the webbing, belt and the like at the printing machine.
Figure 6:
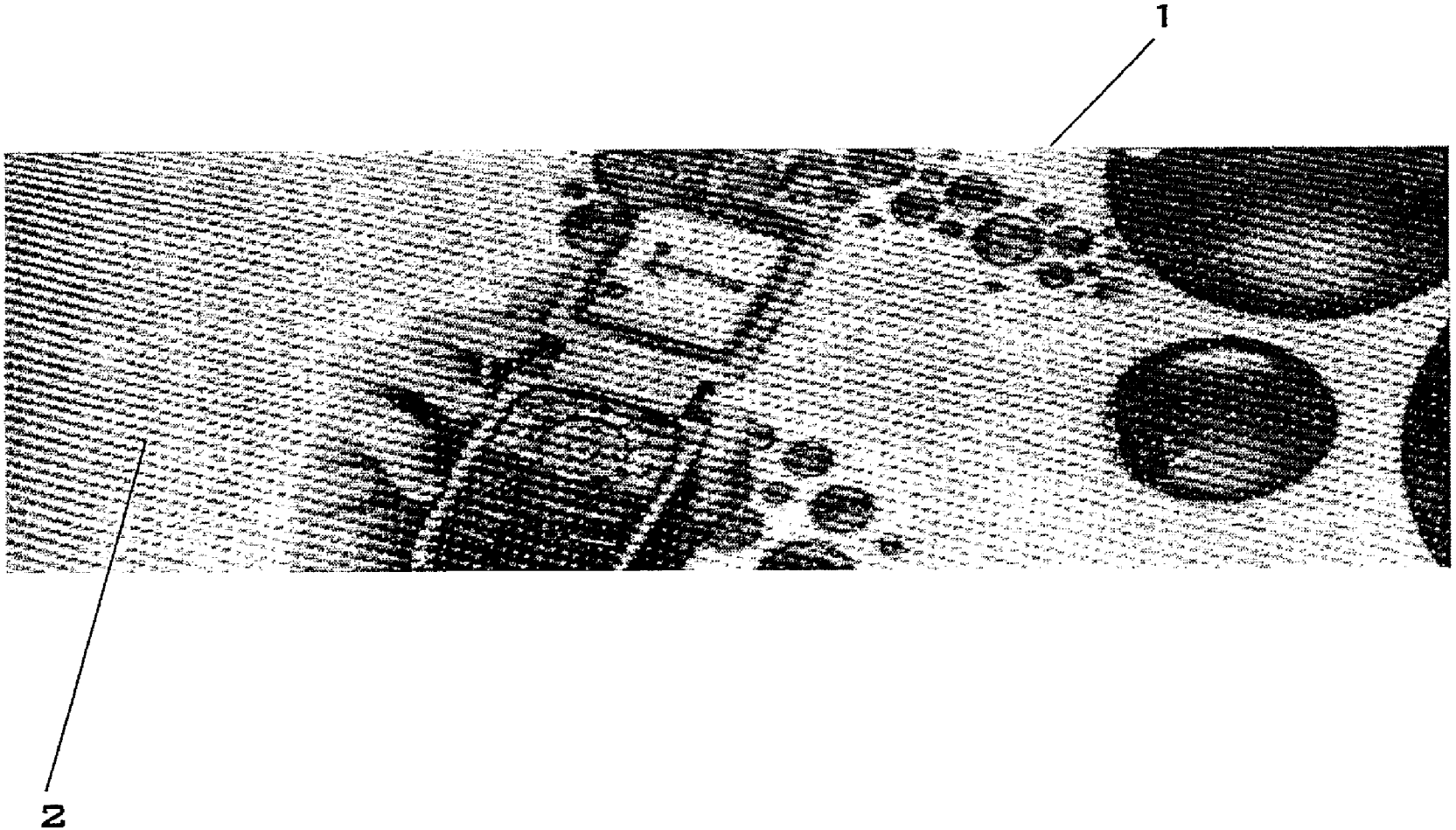
FIG. 6 shows a digital image of a webbing, belt and the like, bearing, the said high quality digital image, obtained through the inventive process, machine and equipment of the present invention.

According to the figures above described, the detailed description of the present PROCESS TO APPLY DIGITAL IMAGES IN STRAPS, APPLIANCE TO THIS APPLICATION AND OBTAINED STRAPS is given in a way to obtain the continuous transferring of digital images or traces to a webbing, belt and the like, where the straps (1) are produced with a conventional weave (2) or with a special weave, in order to receive a bleaching treatment with optical white, as well as to pass through a thermo-fixation process, which creates an alteration in the material properties, enabling, this way, assorted printings of high quality images.

The straps (1) raw material, after being duly treated is wound in reels of specific sizes to allow the digital images continuous transferring, being possible the use of various reels at the same time, it means simultaneously.

The inventive process of the present invention provides a cutting equipment (4), at which is placed a paper reel (3) containing the digital images that shall be transferred to the straps.

At the said cutting equipment (4), the paper reel (3), already printed is assembled at the equipment inlet site (5), being said paper unwound over a flat table (6), upon which is assembled a cutting head (7) which moves laterally, where a series of vertical knives (8) are provided.

Said cutting head (7) contains at one of its ends two optical sensors (9), said optical sensors that identify a line (10) printed in the paper, in a specific color.

The referred optical sensors (9) are connected to a computer central (11) that coordinates the cutting head (7) displacement, being able to displace said cutting head (7) to any positioning or placement variation of the referred line (10), preventing, this way, any difference in the paper cutting, always obeying a predetermined safety margin at each one of the sides.

After being cut, the paper forms reels (12) that are placed at the printing machine (13), along with the synthetic material webbing, belt and the like reels (14).

At the straps (1) printing step, said printing can be provided in said straps (1) both sides/faces in a simultaneous manner and, for such, two reels of paper (12) are used along with one reel of the straps (1).

At said inlet site (15) of the printing machine (13) are provided alignment elements (16) which have specific shapes to enable the papers (12 and 12') passage, as well as the straps (1) passage, aligning them for their inlet into the printing machine (13).

After the passage through the alignment element (16), the paper (12 and 12') and the straps (1) are duly aligned and forwarded inside the printing machine (13), which transfers the images from the paper (12), by sublimation, to the straps (1).

Inside the printing machine (13) two calander cylinders (17) are provided, being one for each side/face of the straps (1).

Said calander cylinders (17) serve to make the straps (1) present images perfectly symmetrical on both sides/faces and for such, between the calander cylinders (17) it is provided an element to keep the temperature steady (18), which keeps the straps (1) temperature during its passage from one calander cylinder to the other.

Said element to keep temperature steady (18) serves the purpose of maximizing the printing process, preventing an uneven material contraction, it means, to avoid that the material in one side/face of the straps (1) shrinks more than the other.

At the back portion of said printing machine (13) the papers (12 and 12'), already used, are wound again into reels (19 and 19') that shall be discarded and the straps (1), already printed in it both faces is duly wound into another reel (20).

During the printing process, since the straps (1) weave presents a certain retraction degree, the straps (1) reels have proper dimensions for the same to achieve the desired dimensions at the end of the referred process.

It means that, due to the straps (1) weave certain retraction degree occurs during the printing process, said retraction is calculated and compensated prior to the printing process begins, so then the final product, already printed comes out in the dimension ordered by the client.

This way, at the end of the process, reels (20) with the straps (1) already printed, are obtained.

The final product reels (20) are unwound and duly cut at the desired length dimension by an ultrasound cutting machine (21), which cuts the straps (1) in its length.

After that, the slit pieces of straps (1) are wound again into small reels (22), which are ready to be assembled where they shall belong.

These obtained small reels (22) of straps (1) of the present invention contain images of digital quality to be used either as advertisement/communication pieces/media or solely as a decorative element.

The obtained straps (1) of the present invention, yet provide the possibility of bearing the printing of safety rules and/or the product identification.

The features described herein were not intended to be taken as restrictive of the invention scope. Other features can be applicable without departing from the scope of the invention.

What is claimed is:

1. Process for transferring digital images from a paper web onto a textured polymeric strap and consisting of:

providing the textured polymeric strap on a reel, treating the straps with a bleaching agent, providing a paper web having digital images imprinted thereon, and having machine readable markers on the paper web to identify discrete digital images and the colors thereof, unwinding the strap from its reel and providing the paper web in accurately indexed relationship onto a surface of the strap, applying heat to the web and the strap and calandering the juxtaposed strap and web to transfer the digital images from the paper web onto the textured strap surface, separating the strap from the web for rewinding onto a storage reel without the paper tape, slitting the strap lengthwise to form side by side belts, said strap being calandered prior to such slitting step, said belts being wound onto separate reels for storage following such slitting step; and optionally further steps of providing a second paper web with digital images and identification markers, and providing the second web on an opposite surface of the strap, followed by providing said second paper web between said calandering rolls along with said first web to transfer images from the paper webs onto both surfaces of said strap.

2. The process according to claim 1 wherein the steps of providing a second paper web with digital images and identification markers, and providing the second web on an opposite surface of the strap, followed by providing said second paper web between said calandering rolls along with said first web to transfer images from the paper webs onto both surfaces of said strap are performed.

* * * * *